US012064678B2

(12) United States Patent
Frazier

(10) Patent No.: US 12,064,678 B2
(45) Date of Patent: Aug. 20, 2024

(54) MODULAR FIELD

(71) Applicant: Soccer Park, LLC, Boise, ID (US)

(72) Inventor: Joshua Leland Frazier, Boise, ID (US)

( * ) Notice: Subject to any disclaimer, the term of this patent is extended or adjusted under 35 U.S.C. 154(b) by 810 days.

(21) Appl. No.: 16/540,843

(22) Filed: Aug. 14, 2019

(65) Prior Publication Data

US 2021/0046372 A1 Feb. 18, 2021

(51) Int. Cl.
*A63B 71/02* (2006.01)
*A63B 63/00* (2006.01)

(52) U.S. Cl.
CPC ..... *A63B 71/022* (2013.01); *A63B 63/004* (2013.01); *A63B 71/023* (2013.01); *A63B 2225/09* (2013.01); *A63B 2243/0025* (2013.01)

(58) Field of Classification Search
CPC ... A63B 71/022; A63B 63/004; A63B 71/023; A63B 2225/09; A63B 2243/0025; E04B 2/00; E05G 1/024
USPC ..... 473/415
See application file for complete search history.

(56) References Cited

U.S. PATENT DOCUMENTS 4,830,341 A * 5/1989 Arteau ..... E04G 21/3276 52/37
5,312,109 A * 5/1994 Cagle ..... A63C 19/00 472/92
5,599,006 A * 2/1997 Gevaux ..... E01F 13/022 256/25
5,683,074 A * 11/1997 Purvis ..... E04G 21/3223 182/113
5,897,438 A * 4/1999 Kunz ..... A63C 19/10 52/287.1
6,053,845 A * 4/2000 Publicover ..... A63B 5/11 482/28
6,394,918 B1 * 5/2002 Erhard ..... A63C 19/06 473/421
2005/0049087 A1 * 3/2005 Martin ..... B32B 17/1033 473/415

(Continued)

FOREIGN PATENT DOCUMENTS

WO WO-0022254 A1 * 4/2000 ..... E04B 2/7401
WO WO-2009013021 A1 * 1/2009 ..... E04H 3/14
WO WO-2010022940 A1 * 3/2010 ..... A01G 9/20

OTHER PUBLICATIONS

Konnerth/Herrmann Translation, All Pages.*

*Primary Examiner* — Melba Bumgarner
*Assistant Examiner* — Rayshun K Peng
(74) *Attorney, Agent, or Firm* — Parsons Behle & Latimer

(57) ABSTRACT

A modular field that includes a plurality of coplanar wall segments connected together by a plurality of stanchions and a plurality of corner stanchions to connect together wall segments oriented perpendicular to each other. The size of the modular field may be varied by the number and/or size of wall segments. Lights may be connected to the corner stanchions. One or more doors to allow ingress into the modular field may be connected to adjacent wall segments by the stanchions. Goals may be connected to wall segments at opposite sides of the modular field by the stanchions. The stanchions may include a base plate, a main support pole connected to the base plate, a channel receptacle connected to the base plate, a rear plate connected to the main support pole, a frame connected to the rear plate, a front plate, and a clamp connected to the main support pole.

30 Claims, 7 Drawing Sheets

(56) References Cited

U.S. PATENT DOCUMENTS

| | | | | |
|---|---|---|---|---|
| 2007/0213146 | A1* | 9/2007 | Lagergren | A63B 67/002 473/415 |
| 2008/0080174 | A1* | 4/2008 | Xu | F21V 33/006 362/152 |
| 2013/0178315 | A1* | 7/2013 | Wright | A63B 63/06 473/470 |
| 2020/0282285 | A1* | 9/2020 | Colling | A63B 71/022 |

* cited by examiner

MODULAR FIELD

FIELD OF THE DISCLOSURE

The embodiments described herein relate to apparatuses, systems, and methods for a modular field. The field may be, but is not limited to, a soccer field.

BACKGROUND

Description of the Related Art

It may be important to have local sporting fields to permit individuals to exercise, engage in sporting contests, and/or engage in various outdoor activities. In some locales, adequate space may not be available for a sporting field. In other areas, there may not be the resources to take care of a grass field. Some areas may have a space available that is smaller than a standard size for a typical sporting fields, such as a soccer field. In some urban areas, the only available spaces may only be on the roof tops of buildings. Other disadvantages may exist.

SUMMARY

The present disclosure is directed to apparatuses, systems, and methods for a modular field that overcomes at least one of the disadvantages discussed above. The field may be, but is not limited to, a soccer field. The modular nature of the modular field disclosed herein may enable the field to be located on top of a building or modified to fit an available space.

An embodiment of the present disclosure is a modular field comprising a plurality of wall segments and a plurality of stanchions. Each stanchion having a base plate, a main support pole connected to the base plate, a channel receptacle connected to the base plate, a rear plate connected to the main support pole, a frame connected to the rear plate, a front plate, and a clamp connected to the main support pole. The main support pole of the stanchion extends substantially perpendicular from the base plate. The modular field includes at least one corner stanchion having a base plate, the base plate having a first channel receptacle and a second channel receptacle, a main support pole connected to the base plate, a first rear plate connected to the main support pole, a second rear plate connected to the main support pole, a first front plate, and a second front plate. The main support pole of the corner stanchion extends substantially perpendicular from the base plate. Each of the plurality of stanchions connects together two adjacent wall segments that are coplanar. The at least one corner stanchion connects together two adjacent wall segments that are oriented perpendicular to each other.

The modular field may include a first goal and a first door, wherein the first goal and first door are each positioned between two wall segments of the plurality of wall segments. The modular field may include a second goal positioned between two wall segments of the plurality of wall segments and a plurality of corner stanchions, wherein each corner stanchion of the plurality of corner stanchions connects together two adjacent wall segments that are oriented perpendicular to each other. The front plate, rear plate, frame, and clamp of each stanchion of the plurality of stanchions may capture a portion of two adjacent wall segments. The channel receptacle may be configured to receive two adjacent wall segments of the plurality of wall segments.

The frame of each stanchion of the plurality of stanchions may be positioned between a gap formed between ends of two adjacent wall segments. The frame may have a rectangular cross-section. One or more fasteners may connect the front plate of each of the plurality of stanchions to the frame of the stanchion. One or more of the stanchions of the plurality of stanchions may include an accessory rod that extends perpendicular from the base plate. An accessory may be connected to the accessory rod. The accessory may be a planter, storage bin, bench, or the like.

Each of the plurality of stanchions may include a secondary pole connected to the main support pole, the secondary pole being substantially perpendicular to the main support pole. A handrail may be connected to the secondary poles of each stanchions of the plurality of stanchions. The first channel receptacle and the second channel receptacle of each corner stanchion of the plurality of corner stanchions may be configured to receive one wall of the plurality of wall segments. The first front plate, first rear plate, second front plate, and second rear plate of each corner stanchion of the plurality of corner stanchions may capture a portion of two adjacent wall segments that are oriented perpendicular to each other.

Each corner stanchion of the plurality of corner stanchions may include a secondary pole connected to the main support pole, the secondary pole being substantially perpendicular to the main support pole. A handrail may be connected to the secondary poles of each of the corner stanchions of the plurality of corner stanchions. A light may be connected to each support pole of each corner stanchion of the plurality of corner stanchions. The modular field may include a second door positioned between two wall segments of the plurality of wall segments. The plurality of wall segments, the first goal, the second goal, the first door, and the second door may form a perimeter. A plurality of connected tiles may be positioned within the perimeter to form a field.

An embodiment of the present disclosure is a stanchion comprising a base plate and a main support pole connected to the base plate. The main support port extends substantially perpendicular to the base plate. The stanchion includes a channel receptacle connected to the base plate and a rear plate connected to the main support pole. The stanchion includes a frame connected to the rear plate and a front plate connected to the frame. The stanchion includes a clamp connected to the main support pole and connected to the frame, wherein the front plate, rear plate, clamp, frame, and channel receptacle from a cavity.

The stanchion may include an accessory rod that extends substantially perpendicular from the base plate. An accessory such as a bench, planter, storage bin, or the like may be connected to the accessory rod. The stanchion may include a secondary pole connected to the main support pole, the secondary pole being substantially perpendicular to the main support pole.

An embodiment of the present disclosure is a stanchion comprising a base plate having a first channel and a second channel, the first channel being substantially perpendicular to the second channel. The stanchion includes a main support pole connected to the base plate, the main support pole extends substantially perpendicular to the base plate. The stanchion includes a first rear plate connected to the main support pole and a second rear plate connected to the main support pole. The stanchion includes a first front plate connected to the first rear plate and a second front plate connected to the second rear plate. The first channel, first rear plate, and first front plate form a first cavity and the second channel, second rear plate, and second front plate form a second cavity that is substantially perpendicular to the first cavity.

The stanchion may include a first accessory rod that extends perpendicular from the base plate and a second accessory rod that extends perpendicular from the base plate. An accessory such as a bench, planter, storage bin, or the like may be connected to the first and second accessory rods. The stanchion may include a secondary pole connected to the main support pole, the secondary pole being substantially perpendicular to the main support pole. The stanchion may include a light connected to the main support pole.

Figure 1:
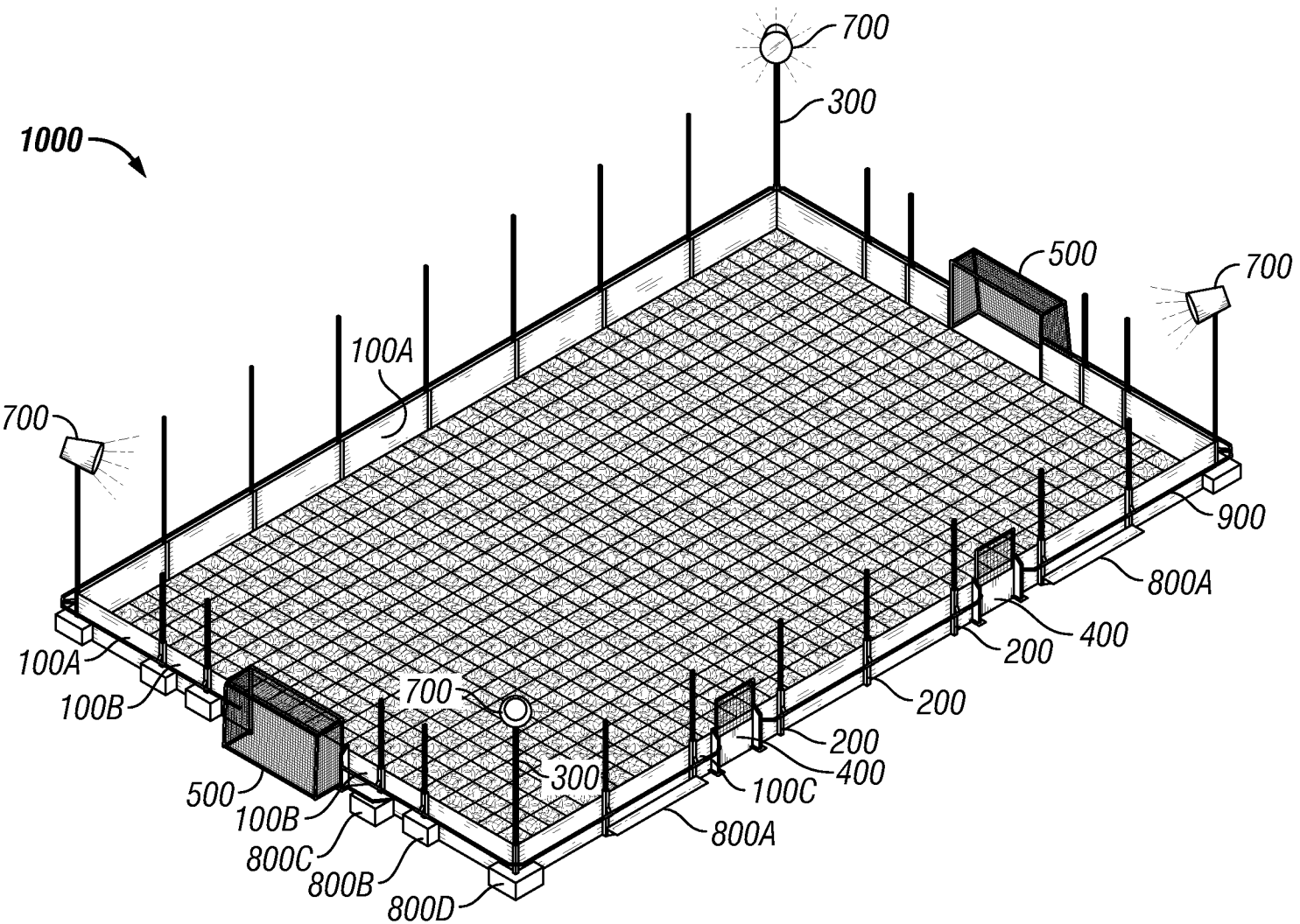
FIG. 1 shows a perspective view schematic of an embodiment of a modular field.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a perspective view of an embodiment of a modular field 1000. The modular field 1000 includes a plurality of wall segments 100A, 100B, 100C that enable the modular nature of the modular field 1000. The wall segments 100A, 100B, 100C, collectively referred to as wall segments 100, (best shown in FIGS. 7, 10, 15, and 16), are connected together by a plurality of stanchions 200 and corner stanchions 300 as discussed herein. The modular field 1000 may include wall segments 100A having a first length, wall segments 100B having a second length, and wall segments 100C having a third length.

Various lengths of wall segments 100A, 100B, 100C may be used to change the size, shape, and/or perimeter of the modular field 1000 as would be appreciated by one of ordinary skill in the art having the benefit of this disclosure. For example, the modular field 1000 may include first wall segments 100A having a length of approximately 10 feet, second wall segments 100B having a length of approximately 5 feet, and third wall segments 100C having a different length. First wall segments 100A may have a first length with the length of the second wall segments 100B being one half of the length of the first wall segments 100A to provide that the configuration of the modular field 1000 may be modified, i.e. be modular in nature. The length of the third wall segments 100C may be adapted to adjust that the length of a door 400 or a goal 500 along with the lengths of adjacent third wall segments 100C equal the length of two wall segments 100A.

The modular field 1000 may include goals 500 located at opposite ends of the modular field 1000 and may include one or more doors 400 to allow egress onto the modular field 1000. A tile field 600 may be provided within the perimeter formed by the wall segments 100, doors 400, and goals 500. Interconnecting tiles 610 (shown in FIGS. 12-14) may be connected to form the tile field 600 as discussed herein. The modular field 1000 may include various accessories such as benches 800A, planter 800B, storage bins 800C, or the like positioned on the outside of the plurality of wall segments 100. The accessories may be connected to the stanchions 200 and corner stanchions 300 as discussed herein. A handrail 800 may be connected to some of the stanchions 200 and corner stanchions 300. The modular field 1000 may include lights 700 connected to the corner stanchions 300. Additional lights may be connected to select stanchions 200, if necessary. The modular field 1000 is shown in FIG. 1 in a soccer configuration for illustrative purposes and may be varied for other sports and/or activities as would be appreciated by one of ordinary skill in the art having the benefit of this disclosure.

Figure 2:
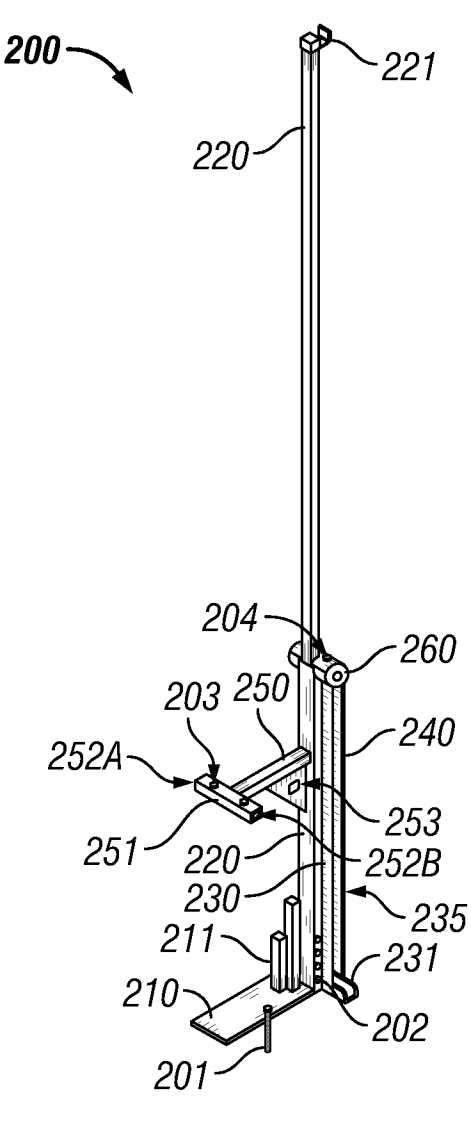
FIG. 2 shows a perspective view schematic of an embodiment of a stanchion.

FIG. 2 shows a perspective view schematic of an embodiment of a stanchion 200. The stanchion 200 includes a base plate 210 that is used to support the stanchion 200 on the ground or other supporting surface. One or more fasteners 201 may optionally fasten the base plate 210 to the ground or other support surface. A main support pole 220 is connected to the base plate 210 and extends substantially perpendicular, or vertical, with respect to the base plate 210.

The main support pole 220 may be connected to the base plate 210 via various mechanisms as would be appreciated by one of ordinary skill in the art. For example, the main support pole 220 may be connected to a projection on the base plate 210 by a plurality of fasteners 202, which enable the height of the main support pole 220 in reference to the base plate 210 to be adjusted. In other words, the main support pole 220 may include a telescopic height adjustment with reference to the base plate 210. The main support pole 220 and corresponding portion of the base plate 210 may include national pipe thread (NPT) taper holes. The NPT holes may be tapered so that they get tighter and tighter the deeper a fastener is threaded into the hole. The use of tapered threaded holes may be able to be used to adjust the height of the main support pole 220 of the stanchion 200 in case the ground or support surface is not perfectly level. Various other types of fasteners may be used, such as, but not limited to, spring buttons, thumb knobs, a threaded rod, or the like.

The base plate 210 of the stanchion 200 includes an accessory rod 211 that extends substantially perpendicular, or vertical from, the base plate 210. The accessory rod 211 enables the connection of various accessories to the base plate 210 of the stanchion 200. For example, the accessory may be, but is not limited to, a bench 800A (shown in FIG. 1), a planter 800B (shown in FIG. 1), a storage bin 800C (shown in FIG. 1), a corner planter 800D, or the like.

The stanchion 200 includes a secondary pole 250 that extends substantially perpendicular, or horizontal, from the main support pole 220. A connector 251 is connected to the end of the secondary pole 250 and the connector 251 includes a first opening 252A and a second opening 252B configured to connect the secondary pole 250 to a handrail 900 (shown in FIG. 1). Fasteners 203 may be used to secure a handrail 900 to the connector 251. The stanchion 200 may include a support 253 connected between the main support pole 220 and the secondary pole 250. The main support pole 220 may include a hook 221, or other connector, located at or near the top of the main support pole 220. The hook 221, or the like, may be used to support electrical wires, support wires, a net, or the like as would be appreciated by one of ordinary skill in the art having the benefit of this disclosure.

Figure 15:
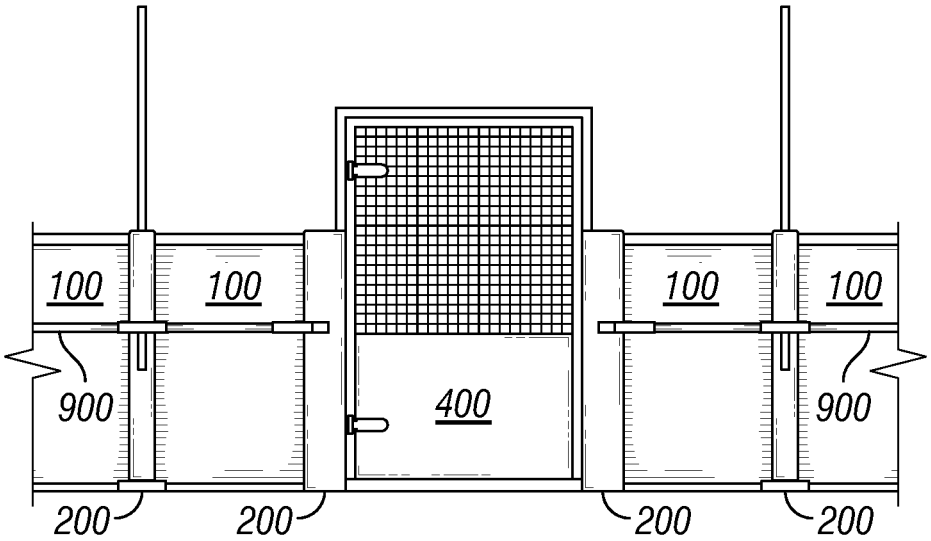
FIG. 15 shows a schematic of a door positioned adjacent wall segments for an embodiment of a modular field.

The stanchion 200 includes a back plate 230 connected to the main support pole 220. The stanchion 200 also include a wall receptacles 231, 232, a front plate 240, and a clamp 260. The stanchion 200 is configured to capture two adjacent wall segments 100 that are aligned with each other. The stanchion 200 includes a gap 235 (best shown in FIG. 3) between the back plate 230 and the front plate 240. The gap 235 is configured to receive the edges of two adjacent wall segments 100. The adjacent wall segments are captured between the back plate 230 and the front plate 240 and the between the wall receptacles 231, 232 and the clamp 260. The stanchion 200 includes a frame 270 (shown in FIG. 5) connected to the main support pole 220 between the back plate 230 and the front plate 240. The frame 270 is configured to close the gap between two adjacent wall segments 100 captured by the components of the stanchion 200. The frame 270 may have a rectangular cross-section. Stanchions 200 may also be used to connect a door 400 to adjacent wall segments 100 as shown in FIG. 15.

Figure 4:
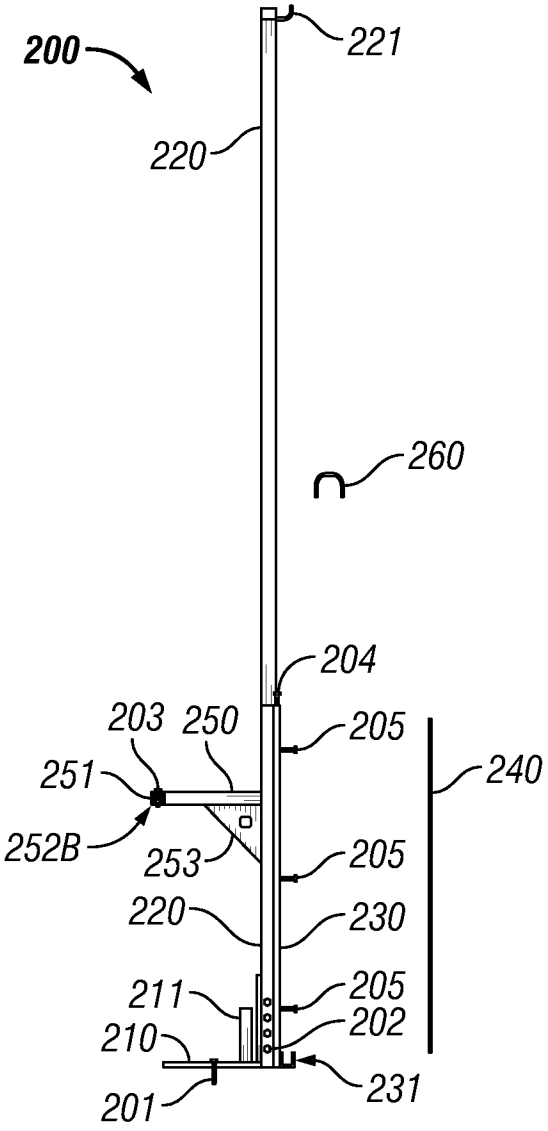
FIG. 4 shows a partially-exploded schematic of the stanchion of FIG. 2.
Figure 3:
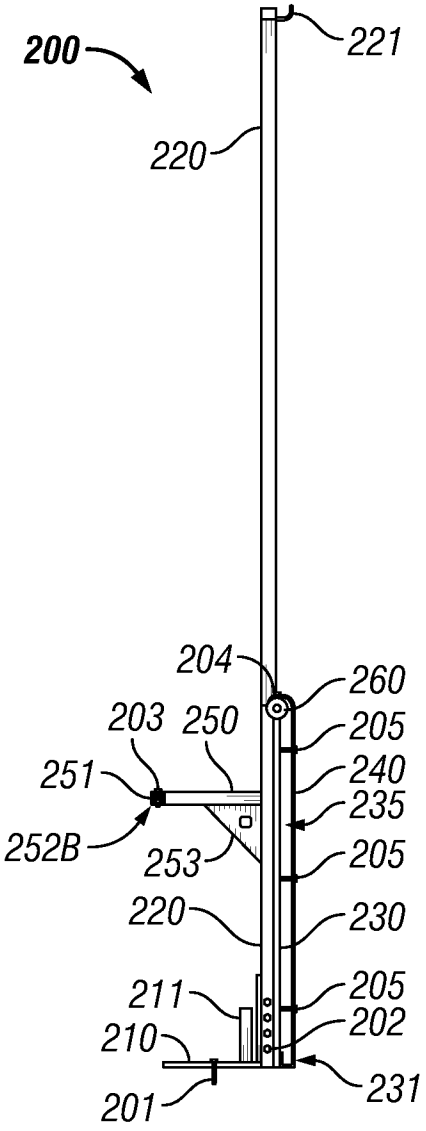
FIG. 3 shows a sideview schematic of the stanchion of FIG. 2.
Figure 5:
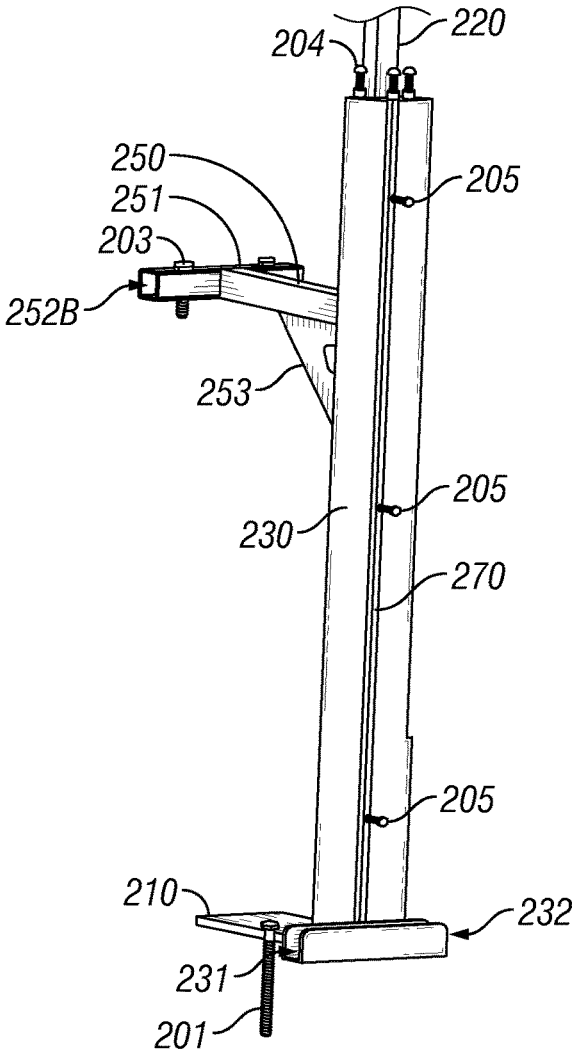
FIG. 5 shows a close-up schematic of a portion of the stanchion of FIG. 2.
Figure 6:
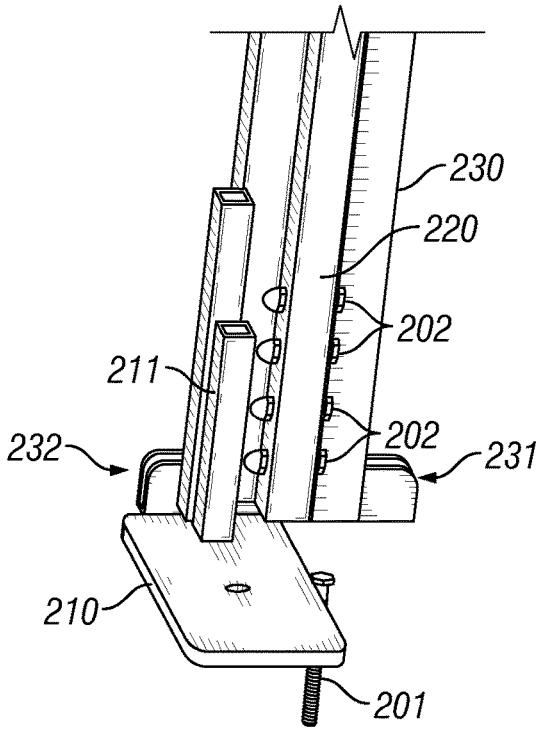
FIG. 6 shows a close-up schematic of a portion of the stanchion of FIG. 2.
Figure 7:
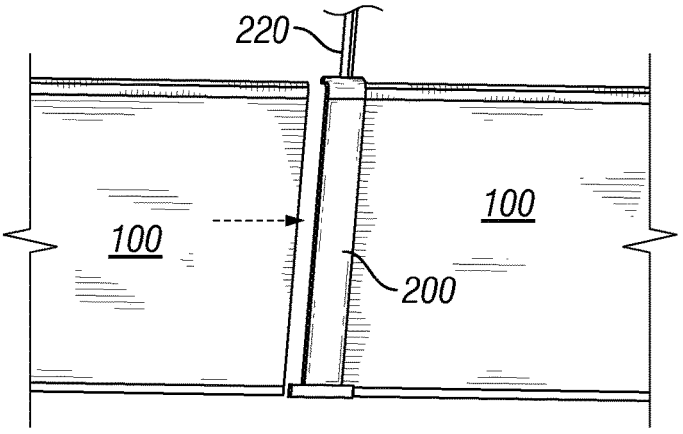
FIG. 7 shows a schematic of two wall segments being connected by an embodiment of a stanchion.

FIG. 3 shows a sideview schematic of the stanchion 200 of FIG. 2. Receptacle 231 is configured to engage the bottom edge of a wall segment 100 that is positioned within the gap 235 between the rear plate 230 and the front plate 240. The front plate 240 is removable, as is shown in FIG. 4, and may be secured to the frame 270 via a plurality of fasteners 205. The clamp 260 is also removable, as shown in FIG. 4, and may be secured to the main support pole 220 and the frame 270 via a plurality of fasteners 204. FIGS. 5 and 6 are close-up schematic views of the stanchion 200 showing the wall receptacles 231, 232. FIG. 5 also shows the frame 270. The front plate 240 and clamp 260 may be removed to enable two wall segments 100 to be positioned within the receptacles 231, 232 to abut against frame 270. The clamp 260 and front plate 240 may then be secured to the frame 270 and main support pole 220 to capture the two adjacent wall segments 100 to form a wall of the modular field 1000 as shown in FIG. 7.

Figure 8:
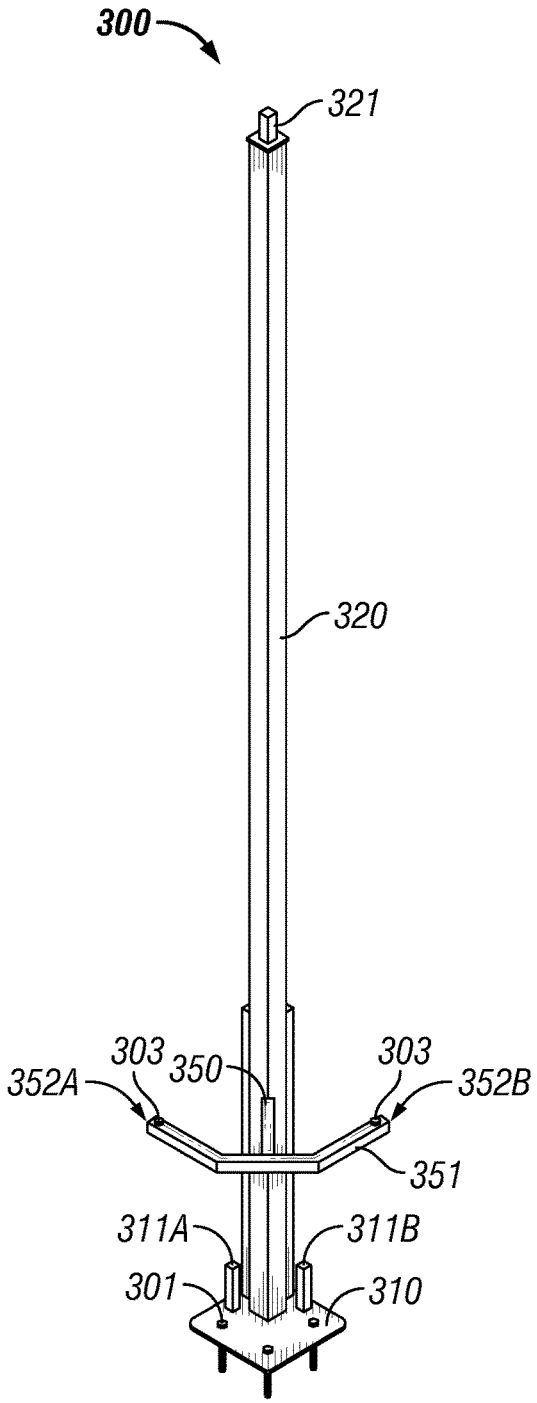
FIG. 8 shows a perspective view of a schematic of an embodiment of a corner stanchion.

FIG. 8 shows a perspective view of a schematic of an embodiment of a corner stanchion 300. Corner stanchions 300 are used to connected together two adjacent wall segments 100 that are oriented perpendicular to each other. The corner stanchion 300 includes a base plate 310 that is used to support the corner stanchion 300 on the ground or other supporting surface. One or more fasteners 301 may optionally fasten the base plate 310 to the ground or other support surface. A main support pole 320 is connected to the base plate 310 and extends substantially perpendicular, or vertical, with respect to the base plate 310. The main support pole 320 may be connected to the base plate 310 via various mechanisms as would be appreciated by one of ordinary skill in the art.

The base plate 310 of the corner stanchion 300 includes one or more accessory rods 311A, 311B that extend substantially perpendicular, or vertical from, the base plate 310. The accessory rods 311A, 311B enable the connection of various accessories to the base plate 310 of the corner stanchion 300. For example, the accessory may be, but is not limited to, a corner planter 800D. The accessory could be a bench 800A, a planter 800B, a storage bin 800C, or the like.

The corner stanchion 300 includes a secondary pole 350 that extends substantially perpendicular, or horizontal, from the main support pole 320. A connector 351 is connected to the end of the secondary pole 350 and the connector 351 includes a first opening 352A and a second opening 352B configured to connect the secondary pole 350 to a handrail 900 (shown in FIG. 1). Fasteners 303 may be used to secure a handrail 900 to the connector 351. The stanchion 300 may include a support 353 connected between the main support pole 320 and the secondary pole 350. The main support pole 320 may include a connector 321 located at the top of the main support pole 320 to connected various accessories to the main support pole 320 of the corner stanchion 300. For example, a light 700 may be connected to the top of the main support pole 320 as shown in FIG. 1.

The corner stanchion 300 includes a first back plate 330A connected to the main support pole 320 and a second back plate 330B connected to the main support pole 320. The corner stanchion 300 also include a wall receptacles 331, 332, which are oriented perpendicular to each other. The corner stanchion 300 includes a first front plate 340A and a second front plate 340B. The first front plate 340A includes a curved portion 341A (best shown in FIG. 9) configured to capture the upper edge of a wall segment 100. Likewise, the second front plate 340B includes a curved portion 341B (best shown in FIG. 9) configured to capture the upper edge of a wall segment 100

Figure 9:
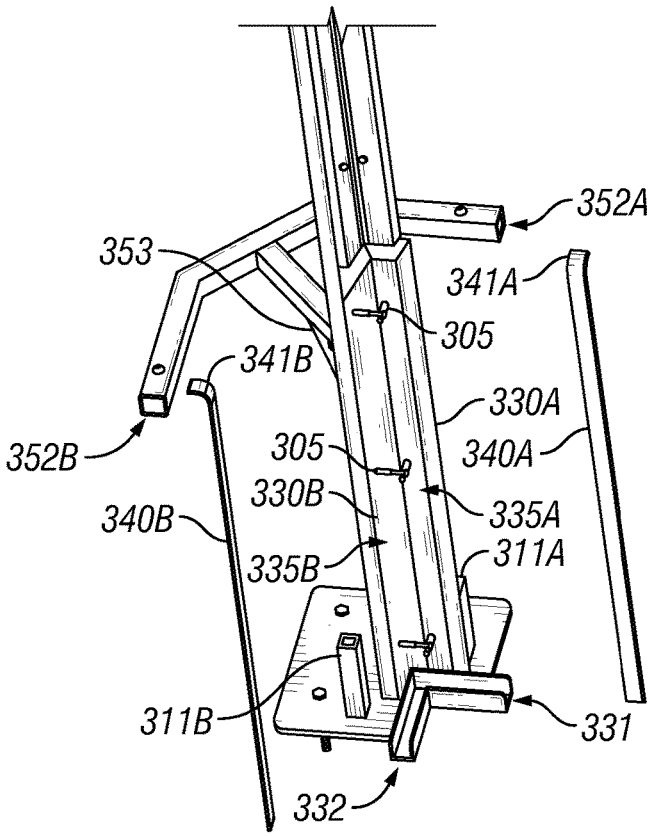
FIG. 9 shows a close-up partially-exploded schematic of a portion of the stanchion of FIG. 8.
Figure 10:
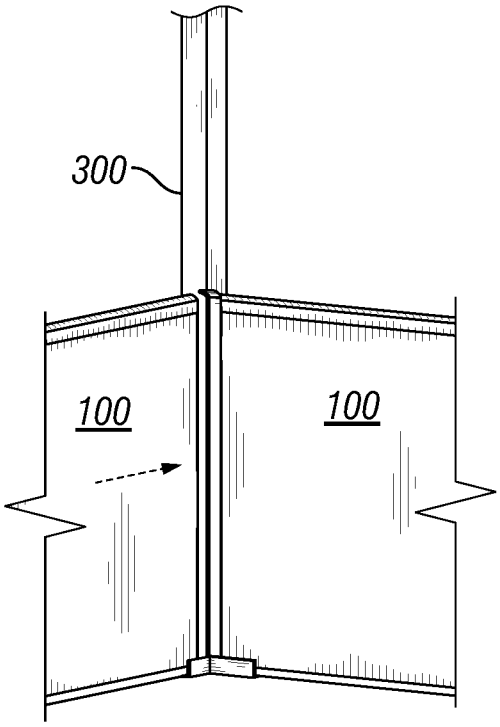
FIG. 10 shows a schematic of two perpendicularly oriented wall segments being connected by an embodiment of a corner stanchion.

FIG. 9 shows a close-up partially-exploded schematic of a portion of the corner stanchion 300. The corner stanchion 300 is configured to capture two adjacent wall segments 100 that are oriented perpendicular to each other. The corner stanchion 300 includes a first gap 335A between the first back plate 330A and the first front plate 340A and a second gap 335B between the second back plate 330B and the second front plate 330B. The gaps 335A, 335 are each configured to receive the edge of two adjacent wall segments 100 oriented perpendicular to each other. One wall segment 100 is captured between the first back plate 330A and the first front plate 340A and the between the first wall receptacle 331 and the curved portion 341A of the first front plate 340A. A perpendicular wall segment 100 is captured between the second back plate 330B and the second front plate 340B and the between the second wall receptacle 332 and the curved portion 341B of the second front plate 340B. A plurality of fasteners 305 may connect the first front plate 340A to the first back plate 330A and may connect the second front plate 340B to the second back plate 330B. The corner stanchion 300 may be used to capture two adjacent perpendicularly oriented wall segments 100 to form a corner of a modular field 1000 as shown in FIG. 10.

Figure 11:
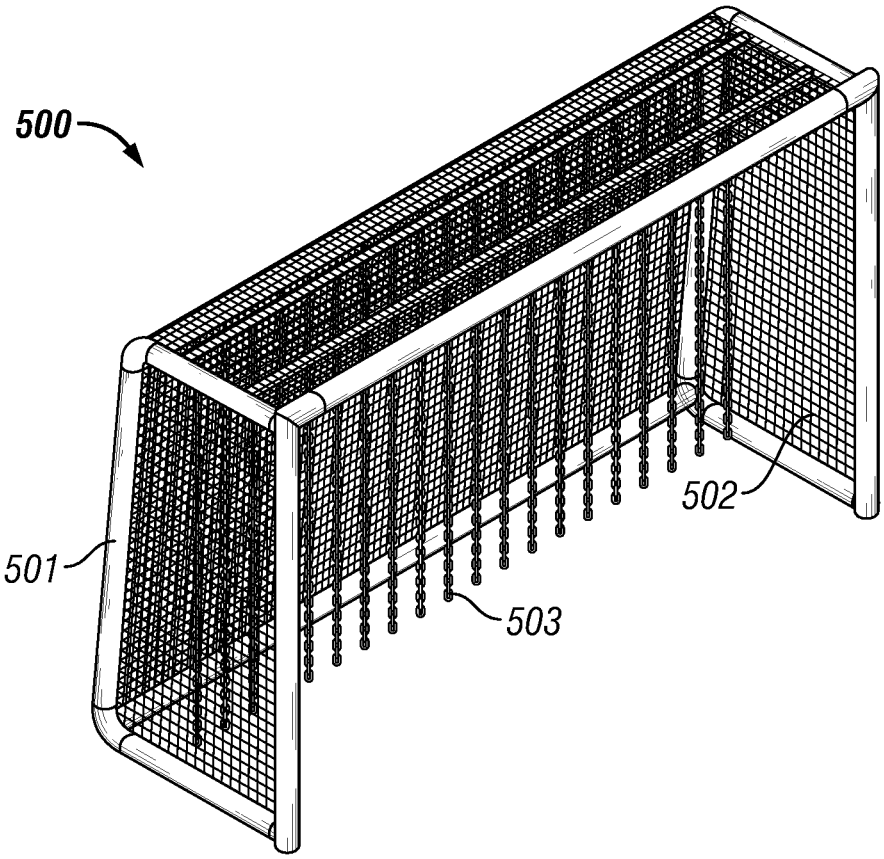
FIG. 11 shows a schematic of an embodiment of a goal.
Figure 16:
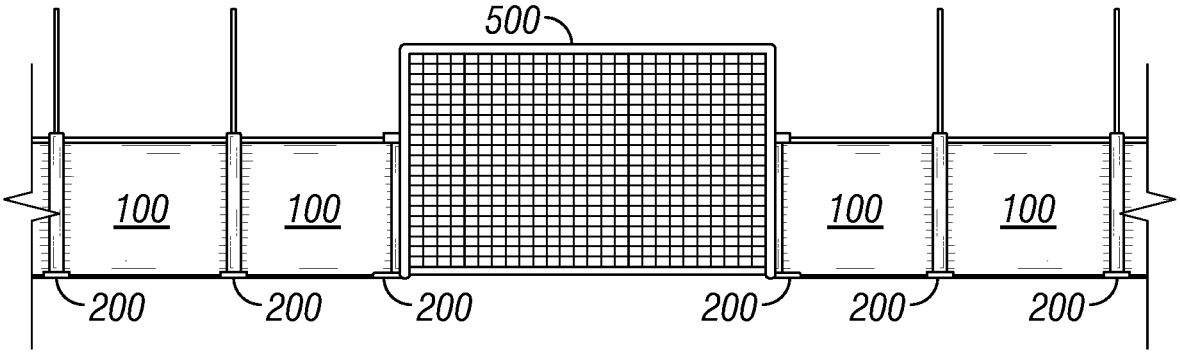
FIG. 16 shows a schematic of a goal positioned adjacent wall segments for an embodiment of a modular field.

FIG. 11 shows an embodiment of a goal 500. The goal includes a frame 501 that may be disassembled for ease of shipping. A net 502 is connected to the frame 501 to capture a ball that enters the goal 500. The goal 500 may include a plurality of chain lengths 503 vertically suspended within the goal 500. The chain lengths 503 may make an audible noise when struck by a ball or object entering the goal 500. Stanchions 200 may be used to connect a goal 500 to adjacent wall segments 100 as shown in FIG. 16.

Figure 12:
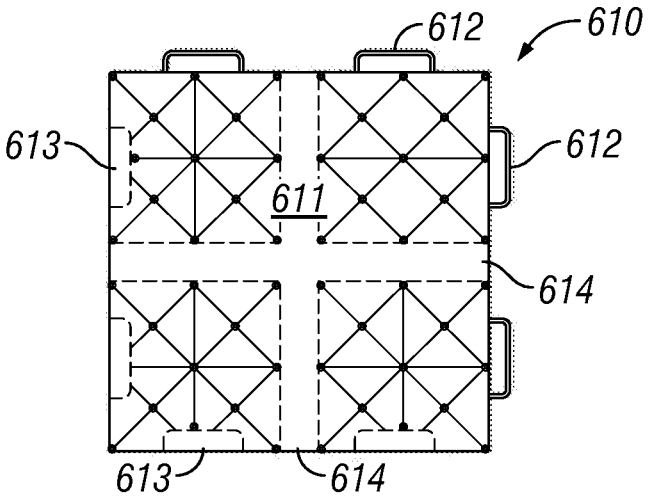
FIG. 12 shows a top view schematic of an embodiment of a field tile.
Figure 13:
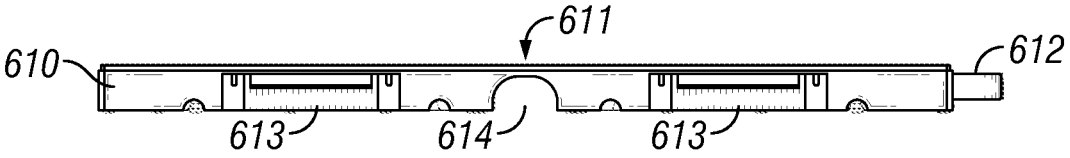
FIG. 13 shows a side view schematic of an embodiment of a field tile.
Figure 14:
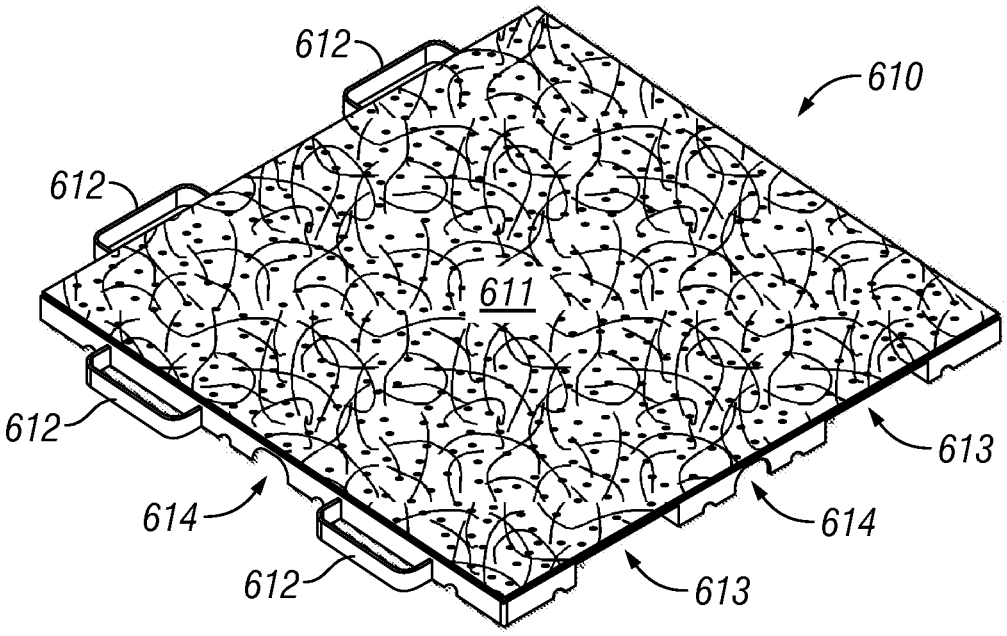
FIG. 14 shows a perspective view schematic of an embodiment of a field tile.

FIG. 12 shows a top view schematic of an embodiment of a field tile 610. The field tile 610 includes a top surface 611 with one or more projections 612 that project beyond the edge of the top surface 611. The field tile 610 includes one or more recesses 613 below the top surface 611 of the field tile 610. Each of the one or more recesses 613 are configured to receive a projection 612 from an adjacent field tile 610. In this way, a field 600 may be comprised by a plurality of field tiles 610 connected together. The field tile 610 includes passages 614 through the field tile 610. The passage 614 may enable electrical lines, hydraulic conduits, or the like to pass across a modular field 1000 undeath the tile field 600. FIG. 13 shows a side view schematic of a field tile 610 and FIG. 14 shows a perspective view schematic of a field tile 610. As discuss herein, the field tile 610 includes passages 614 that enable cables, wires, hoses, or the like to pass underneath the field tile 610. Field tile 610 also includes one or more projections 612 and recesses 613 that enable adjacent field tiles 610 to be connected together to form a field 600 for a modular field 1000.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A modular field comprising:

a plurality of wall segments;

a plurality of stanchions, each stanchion of the plurality of stanchions having a base plate, a main support pole connected to the base plate, a channel receptacle connected to the base plate, a rear plate connected to the main support pole, a frame connected to the rear plate, the frame connected to a front plate, and a clamp, the clamp connected to the main support pole and to the frame; wherein the main support pole extends substantially perpendicular from the base plate;

at least one corner stanchion having a base plate, the base plate having a first channel receptacle and a second channel receptacle, a main support pole connected to the base plate of the at least one corner stanchion, a first rear plate of the at least one corner stanchion connected to the main support pole of the at least one corner stanchion, a second rear plate of the at least one corner stanchion connected to the main support pole of the at least one corner stanchion, a first front plate of the at least one corner stanchion, and a second front plate of the at least one corner stanchion, wherein the main support pole extends substantially perpendicular from the base plate of the at least one corner stanchion;

wherein each of the plurality of stanchions connects together two adjacent wall segments that are coplanar;

wherein the at least one corner stanchion connects together two adjacent wall segments that are oriented perpendicular to each other;

wherein the main support pole of each stanchion of the plurality of stanchions extends above a top edge of adjacent wall segments of the plurality of wall segments and wherein the clamp is positioned adjacent the top edge of the adjacent wall segments; and wherein the main support pole is directly connected to the base plate of each stanchion of the plurality of stanchions.

2. The modular field of claim 1, wherein a height of the main support pole may be varied with respect to the base plate.

3. The modular field of claim 1, comprising a first goal and a first door, wherein the first goal and first door are each positioned between two adjacent wall segments of the plurality of wall segments.

4. The modular field of claim 3, comprising a second goal positioned between two wall segments of the plurality of wall segments and a plurality of corner stanchions, wherein each corner stanchion of the plurality of corner stanchions connects together two adjacent wall segments that are oriented perpendicular to each other.

5. The modular field of claim 4, wherein the front plate, rear plate, frame, and clamp of each stanchion of the plurality of stanchions captures a portion of two adjacent wall segments.

6. The modular field of claim 5, wherein the channel receptacle is configured to receive two adjacent wall segments of the plurality of wall segments.

7. The modular field of claim 6, wherein the frame of each stanchion of the plurality of stanchions is positioned between a gap formed between ends of two adjacent wall segments.

8. The modular field of claim 7, wherein the frame has a rectangular cross-section.

9. The modular field of claim 7, wherein one or more fasteners connect the front plate of each of the plurality of stanchions to the frame of the stanchion.

10. The modular field of claim 9, wherein one or more of the stanchions of the plurality of stanchions includes an accessory rod that extends perpendicular from the base plate.

11. The modular field of claim 10, further comprising an accessory connected to the accessory rod.

12. The modular field of claim 11, wherein the accessory is a planter, storage bin, or bench.

13. The modular field of claim 10, wherein each of the plurality of stanchions includes a secondary pole connected to the main support pole, the secondary pole being substantially perpendicular to the main support pole.

14. The modular field of claim 13, further comprising a handrail connected to the secondary poles of each stanchions of the plurality of stanchions.

15. The modular field of claim 14, wherein the first channel receptacle and the second channel receptacle of each corner stanchion of the plurality of corner stanchions is configured to receive one wall of the plurality of wall segments.

16. The modular field of claim 15, wherein the first front plate, first rear plate, second front plate, and second rear plate of each corner stanchion of the plurality of corner stanchions captures a portion of two adjacent wall segments that are oriented perpendicular to each other.

17. The modular field of claim 16, wherein each corner stanchion of the plurality of corner stanchions includes a first accessory rod that extends perpendicular from the base plate and a second accessory rod that extends perpendicular from the base plate.

18. The modular field of claim 17, wherein each corner stanchion of the plurality of corner stanchions includes a secondary pole connected to the main support pole, the secondary pole being substantially perpendicular to the main support pole.

19. The modular field of claim 18, further comprising a handrail connected to the secondary poles of each of the corner stanchions of the plurality of corner stanchions.

20. The modular field of claim 19, further comprising a light connected to each support pole of each corner stanchion of the plurality of corner stanchions.

21. The modular field of claim 20, further comprising a second door, wherein the second door is positioned between two wall segments of the plurality of wall segments.

22. The modular field of claim 21, wherein the plurality of wall segments, the first goal, the second goal, the first door, and the second door form a perimeter.

23. The modular field of claim 22, further comprising a plurality of connected tiles positioned within the perimeter to form a field.

24. The modular field of claim 1, wherein the channel receptacle of each stanchion of the plurality of stanchions is positioned between the front plate and the rear plate and wherein the rear plate is between the channel receptacle and the main support pole.

25. The modular field of claim 4, further comprising a second door, wherein the second door is positioned between two wall segments of the plurality of wall segments.

26. The modular field of claim 25, wherein the plurality of wall segments, the first goal, the second goal, the first door, and the second door form a perimeter.

27. The modular field of claim 26, further comprising a plurality of connected tiles positioned within the perimeter to form a field.

28. A modular field comprising:

a plurality of wall segments;

a plurality of stanchions, each stanchion of the plurality of stanchions having a base plate, a main support pole connected to the base plate, a channel receptacle connected to the base plate, a rear plate connected to the main support pole, a frame connected to the rear plate, the frame connect to a front plate, and a clamp, the clamp connected to the main support pole and the frame; wherein the main support pole extends substantially perpendicular from the base plate;

at least one corner stanchion having a base plate, the base plate having a first channel receptacle and a second channel receptacle, a main support pole connected to the base plate of the at least one corner stanchion, a first rear plate of the at least one corner stanchion connected to the main support pole of the at least one corner stanchion, a second rear plate of the at least one corner stanchion connected to the main support pole of the at least one corner stanchion, a first front plate of the at least one corner stanchion, and a second front plate of the at least one corner stanchion, wherein the main support pole extends substantially perpendicular from the base plate of the at least one corner stanchion;

wherein each of the plurality of stanchions connects together two adjacent wall segments that are coplanar;

wherein the at least one corner stanchion connects together two adjacent wall segments that are oriented perpendicular to each other;

wherein one or more of the stanchions of the plurality of stanchions includes an accessory rod that extends perpendicular from the base plate;

an accessory connected to the accessory rod;

wherein the accessory is a planter, storage bin, or bench;

wherein the main support pole of each stanchion of the plurality of stanchions extends above top edges of adjacent wall segments of the plurality of wall segments and wherein the clamp is positioned adjacent the top edges of adjacent wall segments; and wherein the main support pole is directly connected to the base plate of each stanchion of the plurality of stanchions.

29. The modular field of claim 28, wherein each of the plurality of stanchions includes a secondary pole connected to the main support pole, the secondary pole being substantially perpendicular to the main support pole and further comprising a handrail connected to the secondary poles of each stanchions of the plurality of stanchions.

30. The modular field of claim 29, further comprising a light connected to each support pole of each corner stanchion of the plurality of corner stanchions.

* * * * *